US007229298B2

(12) United States Patent
Shen et al.

(10) Patent No.: US 7,229,298 B2
(45) Date of Patent: Jun. 12, 2007

(54) ELECTRICAL CONNECTOR HAVING AN IMPROVED GROUNDING PATH

(75) Inventors: Guo-Jian Shen, Kunsan (CN); Chi Zhang, Kunsan (CN); Ren-Chih Li, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/168,611

(22) Filed: Jun. 27, 2005

(65) Prior Publication Data

US 2006/0121782 A1 Jun. 8, 2006

(30) Foreign Application Priority Data

Dec. 3, 2004 (TW) ..... 93219490 U

(51) Int. Cl.
*H01R 4/66* (2006.01)
*H01R 13/648* (2006.01)

(52) U.S. Cl. ..... 439/95; 439/101; 439/607

(58) Field of Classification Search ..... 439/95, 439/96, 101, 108, 607, 79, 629, 630
See application file for complete search history.

(56) References Cited

U.S. PATENT DOCUMENTS

| | | | | |
|---|---|---|---|---|
| 3,587,029 | A * | 6/1971 | Knowles | 439/607 |
| 4,842,529 | A * | 6/1989 | Frantz et al. | 439/95 |
| 6,039,583 | A * | 3/2000 | Korsunsky et al. | 439/101 |
| 6,074,223 | A * | 6/2000 | Huang | 439/95 |
| 6,338,652 | B1 * | 1/2002 | Ko | 439/497 |
| 6,811,439 | B1 | 11/2004 | Shin-Ting | |

* cited by examiner

*Primary Examiner*—Felix O. Figueroa
(74) *Attorney, Agent, or Firm*—Wei Te Chung

(57) ABSTRACT

An electrical connector (1) including a longitudinal housing (10) defining a mating slot (100); a plurality of signal terminals (31) loaded in the housing and arranged in a row along a longitudinal direction of the housing, each signal terminal having a solder tail (302) to be soldered to a printed circuit board (PCB) and a contact portion (303) extending into the mating slot; at least a grounding terminal (32) arranged in the same row of the signal terminals and having a solder tail coplanar with the solder tails of the signal terminals; a conductor means (40) loaded in the housing and partly extending into the mating slot to oppositely facing the contact portions of the signal terminals; and a shell (20) surrounding the housing and electrically connected to the conductor means and the grounding terminals.

17 Claims, 6 Drawing Sheets

ELECTRICAL CONNECTOR HAVING AN IMPROVED GROUNDING PATH

BACKGROUND OF THE INVENTION

1. Field of the Invention

The present invention relates to an electrical connector, and more particularly to an electrical connector having a grounding path to a printed circuit board on which the connector is mounted.

2. Description of Related Art

U.S. Pat. No. 6,811,439 discloses a thin connector comprising an elongated, rectangular insulative housing, a plurality of electrical terminals, a metal plate, and a shell. The housing includes an upper wall and a lower wall, which cooperate to define a longitudinal mating opening for accommodating a mating part of a mating connector. The electrical terminals are arranged in a row and each has a contact beam projecting into the mating opening along the upper wall and a solder tail to be soldered to a printed circuit board (PCB). The metal plate is attached to the lower wall and has a plurality of elastic tongues extending therefrom and projecting into the mating cavity for abutting against the mating connector being plugged in to provide an elastic force thereon opposite to that provided by the contact beams of the terminals for equilibrium purpose. The shell is attached to a periphery of the housing therefore to surround the housing.

The metal plate further comprises a pair of grounding legs bended to be soldered onto the PCB as well as the solder tails of the terminals. As the connector is soldered onto the PCB by a Surface Mounting Technology (SMT), it is required that the solder tails of the terminals and the grounding legs of the metal plate which are together to be surface soldered to the PCB perform a good coplanarity, or else neither facility nor reliability of soldering operation can't be ensured. However, since the terminals and the metal plate are formed from different metal sheets and are assembled on the housing separately, it is difficult to ensure a wonderful coplanarity between said solder tails and said grounding legs.

Thus it is desired to provide an electrical connector in which both a grounding path thereof and solder tails of terminals thereof are reliably soldered to a PCB with facility, and in which the grounding path and the solder tails of terminals together to be soldered to the PCB perform a good coplanarity.

SUMMARY OF THE INVENTION

An object of the present invention is to provide an electrical connector in which both a grounding path thereof and solder tails of terminals thereof are reliably soldered to a printed circuit board (PCB) with facility.

Another object of the present invention is to provide an electrical connector in which a grounding path and solder tails of terminals together to be surface soldered to a PCB perform a good coplanarity.

In order to achieve above-mentioned objects, an electrical connector of the present invention includes a longitudinal housing defining a mating slot; a plurality of signal terminals loaded in the housing and arranged in a row along a longitudinal direction of the housing, each signal terminal having a solder tail to be soldered to a PCB and a contact portion extending into the mating slot; at least a grounding terminal arranged in the same row of the signal terminals and having a solder tail coplanar with the solder tails of the signal terminals; a conductor means loaded in the housing and partly extending into the mating slot to oppositely facing the contact portions of the signal terminals; and a shell surrounding the housing and electrically connected to the conductor means and the grounding terminals.

Other objects, advantages and novel features of the present invention will become more apparent from the following detailed description of the present embodiment when taken in conjunction with the accompanying drawings.

DETAILED DESCRIPTION OF THE INVENTION

Figure 1:
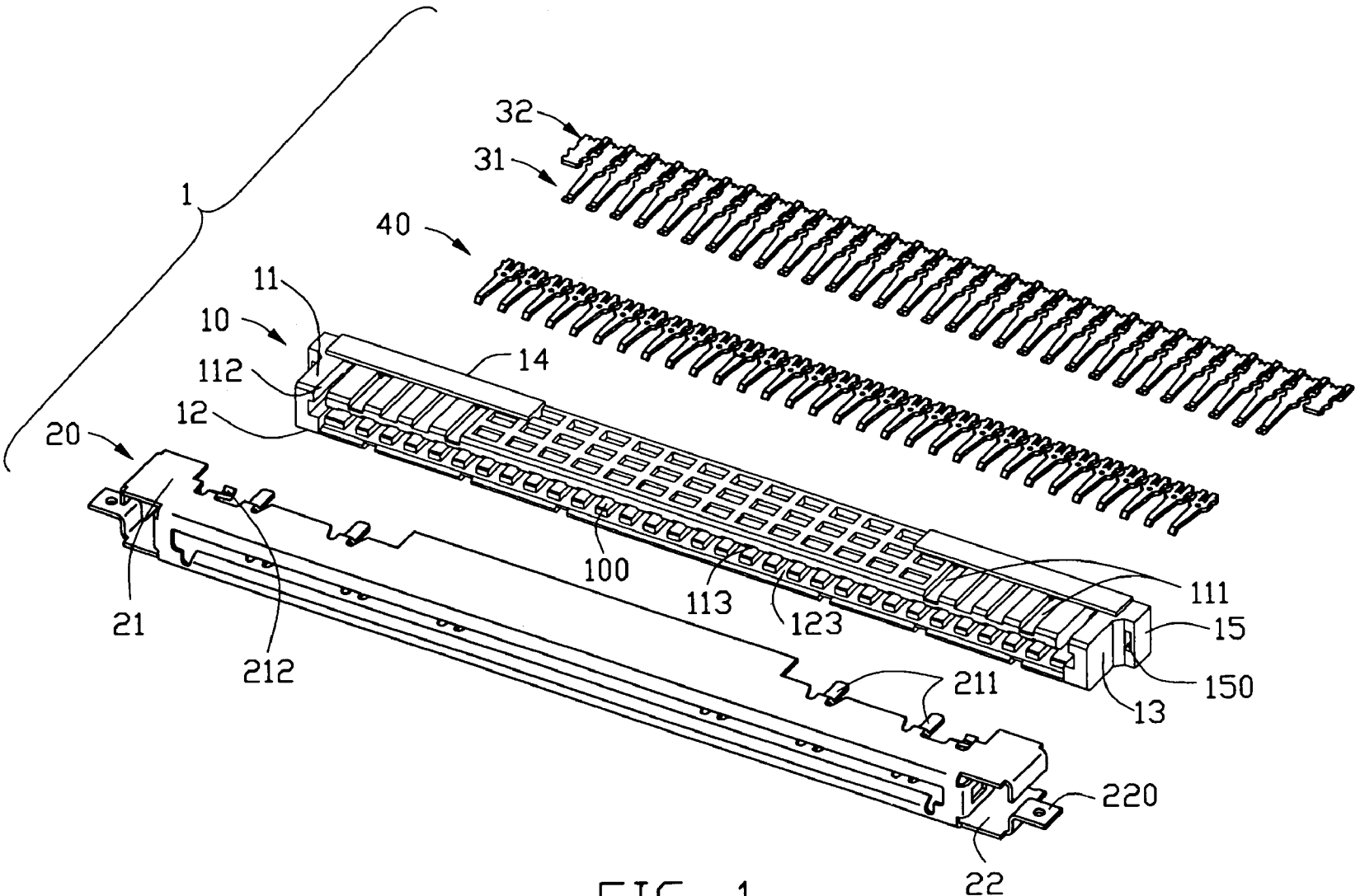
FIG. 1 is an exploded perspective view of an electrical connector in accordance with the preferred embodiment of the present invention.

Reference will now be made to the drawing figures to describe the preferred embodiment of the present invention in detail.

Figure 3:
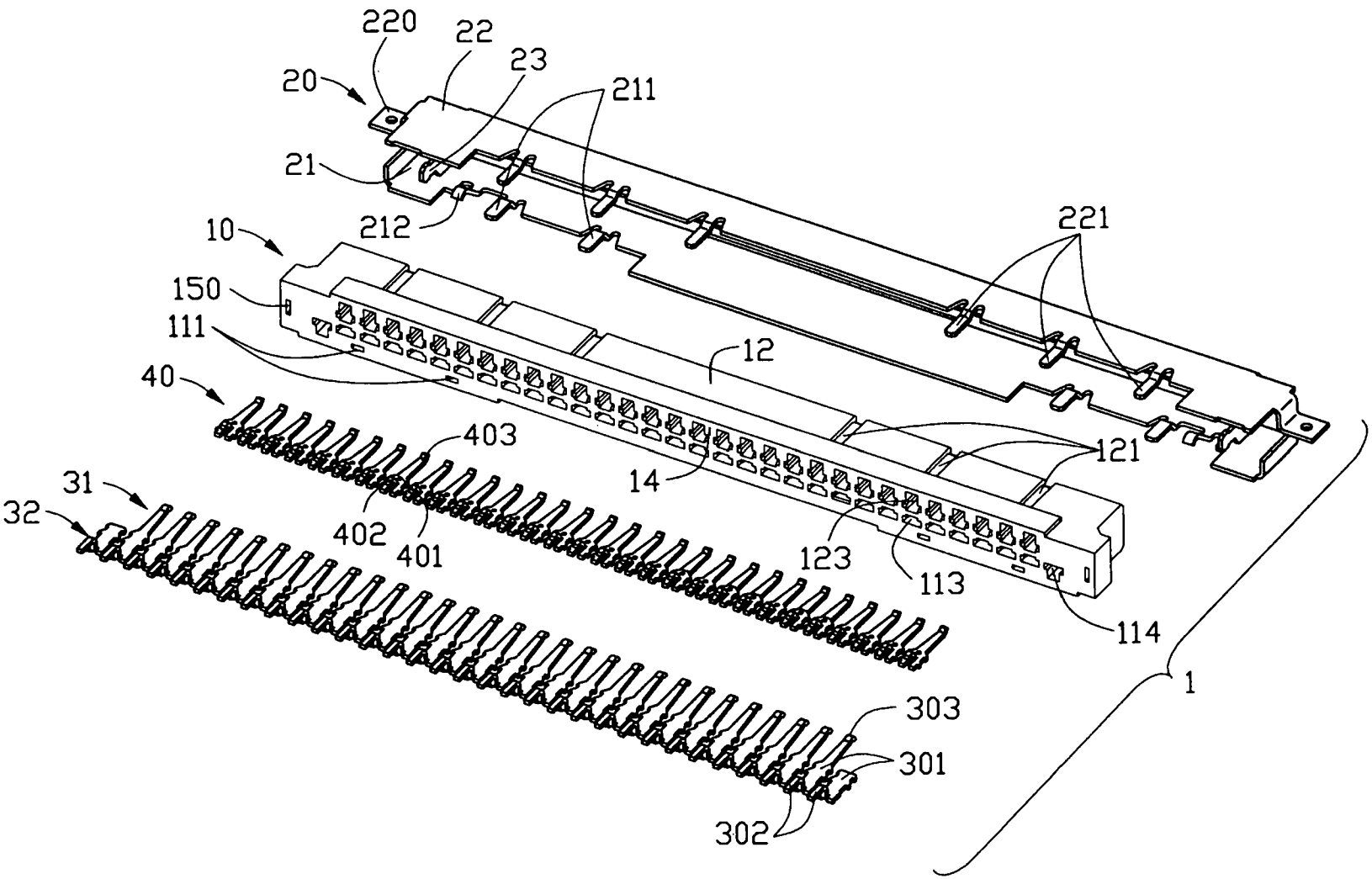
FIG. 3 is another exploded perspective view of the electrical connector taken from an aspect different from that of FIG. 1.

Referring to FIGS. 1 and 3, an electrical connector 1 in accordance with the present invention includes a longitudinal housing 10, a plurality of signal terminals 31, a pair of grounding terminals 32, a plurality of elastic terminals 40, and a shell 20. The housing 10 is a rectangular case comprising a rear base 14, an upper wall 11, a lower wall 12, and a pair of side walls 13, all of which cooperate to define a mating slot 100 therebetween for receiving a mating portion of a complemental connector (not shown). The upper wall 11 defines a row of upper channels 113 on its inner face that is adjacent to the mating slot 100 for accommodating the signal terminals 31, and the lower wall 12 defines a row of lower channels 123 also on an inner face thereof for accommodating the elastic terminals 40. Both the upper channels 113 and the lower channels 123 run along a front-to-back direction that is an insertion direction of the complemental connector and extend throughout the rear base 14 (shown in FIG. 3). Otherwise, at longitudinal ends of the row of upper channels 113 are a pair of side upper channels 114 for accommodating the grounding terminals 32 which are respectively defined through the rear base 14 adjacent to the side walls 13 and aligned with the upper channels 113.

Concerning the terminals 31, 32, 40, the signal terminals 31 and the grounding terminals 32 are punched from one and the same metal sheet and thus are arranged in a row wherein that two terminals positioned in longitudinal ends of the row are the grounding terminals 32 and the others are the signal terminals 31. Preliminary, the whole row of terminals, including the signal terminals 31 and the grounding terminals 32, is an integral one that linked by a tailing (not shown) of the metal sheet from which the terminals are punched. Then the whole row of terminals is assembled to the housing 10 along a back-to-front direction, thereby the signal terminals 31 and the grounding terminals 32 are respectively and correspondingly inserted into the upper channels 113 and the side upper channels 114. Lastly, the tailing is cut from the terminals 31, 32 and thus the terminals 31, 32 are separated from each other. Alike, the elastic terminals 40 formed from another metal sheet are assembled to the housing 10 to be correspondingly accommodated in the lower channels 123 and thus arranged in a second row that oppose to the row of the signal terminals 31 and the grounding terminals 32.

Figure 5:
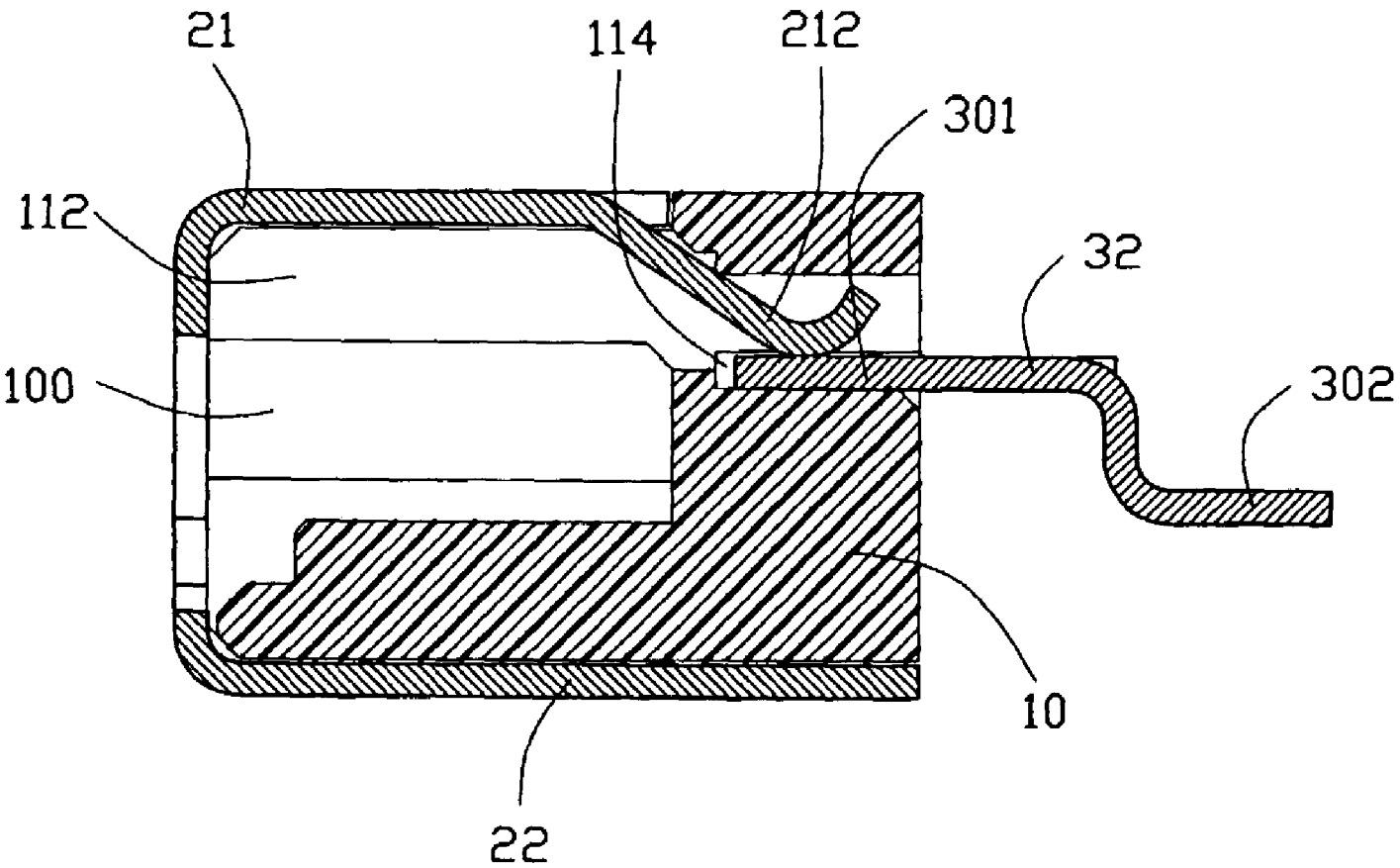
FIG. 5 is a cross-sectional view taken along the line 5—5 in FIG. 2.
Figure 6:
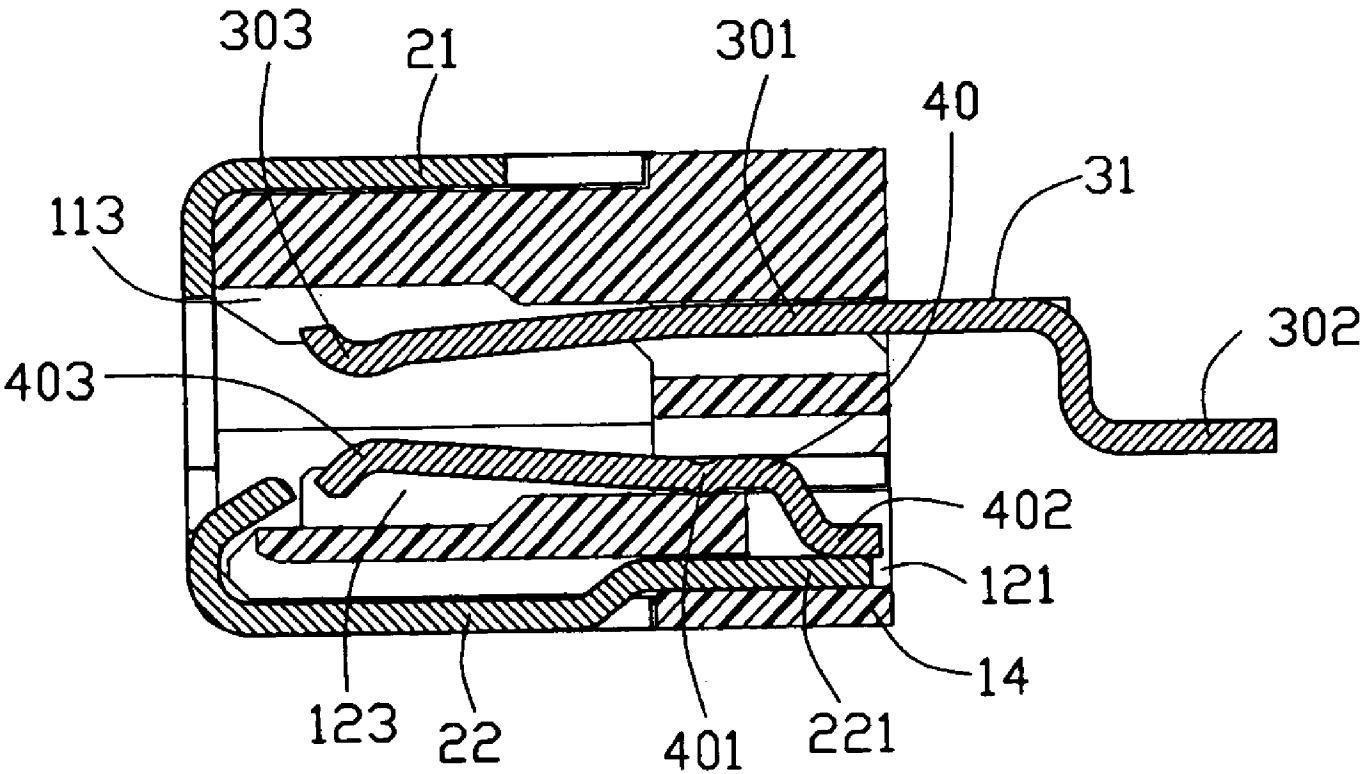
FIG. 6 is a cross-sectional view taken along the line 6—6 in FIG. 2.

As best shown in FIGS. 5 and 6, both the signal terminals 31 and the grounding terminals 32 each comprises a retaining portion 301 for retaining in the housing 10, actually, the rear base 14 of the housing 10, and a solder tail 302 extending rearwards from the retaining portion 301 and out of the housing 10 to be soldered onto a printed circuit board (PCB) (not shown), wherein each signal terminal 31 further comprises a resilient beam with a contact point 303 extending forwards from the retaining portion 301 and protruding into the mating slot 100 for contacting conductors on the complemental connector. The elastic terminals 40 each comprises a retaining portion 401 retained in the rear wall 14 of the housing 10, a bend portion 402 extending rearwards from the retaining portion 401, and a resilient beam with a contact point 403 extending forwards from the retaining portion 401 and protruding into the mating slot 100 for abutting against the mating portion of the complemental connector to provide an properly enough contact force between the conductors and the signal terminals 31.

Figure 2:
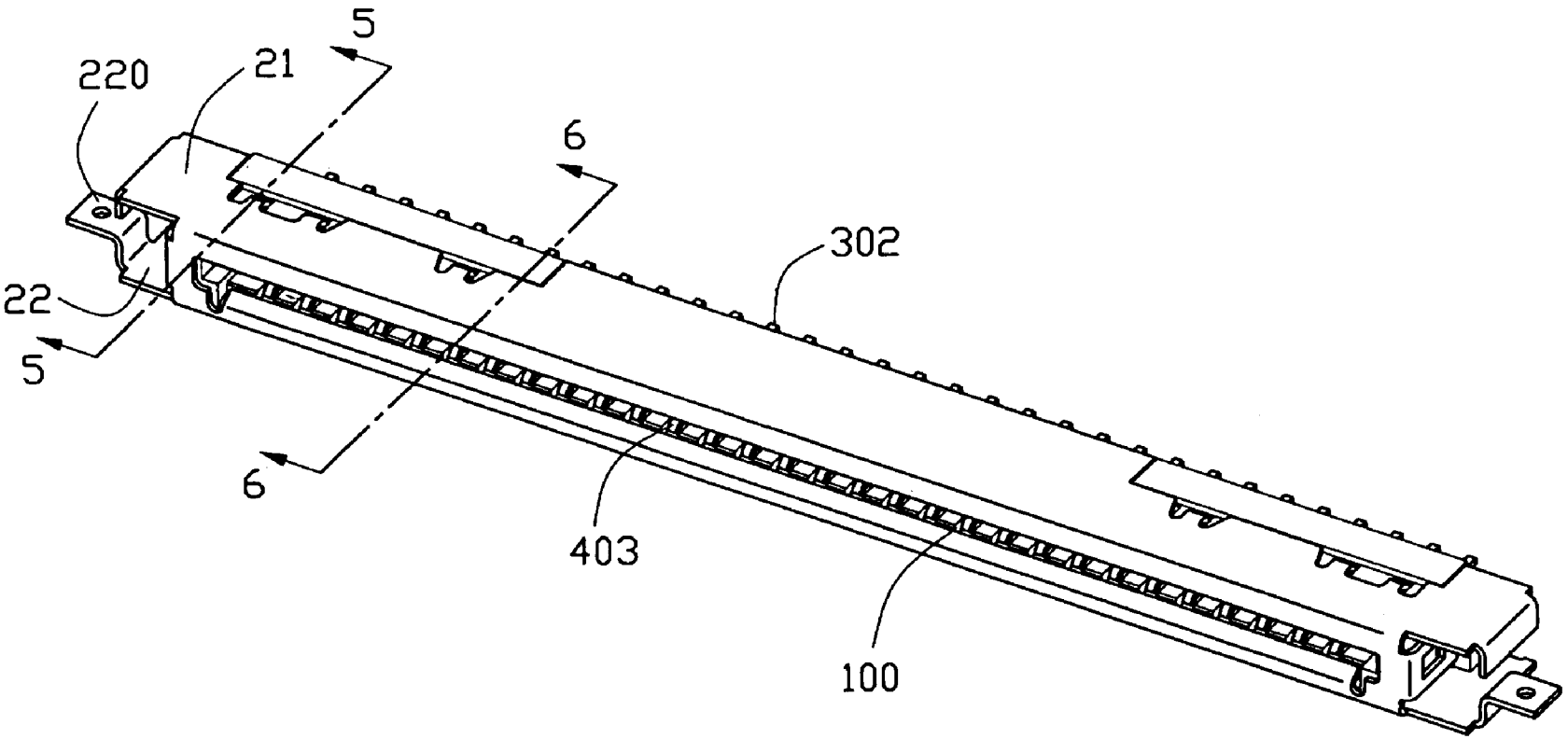
FIG. 2 is an assembled perspective view of the electrical connector of FIG. 1.
Figure 4:
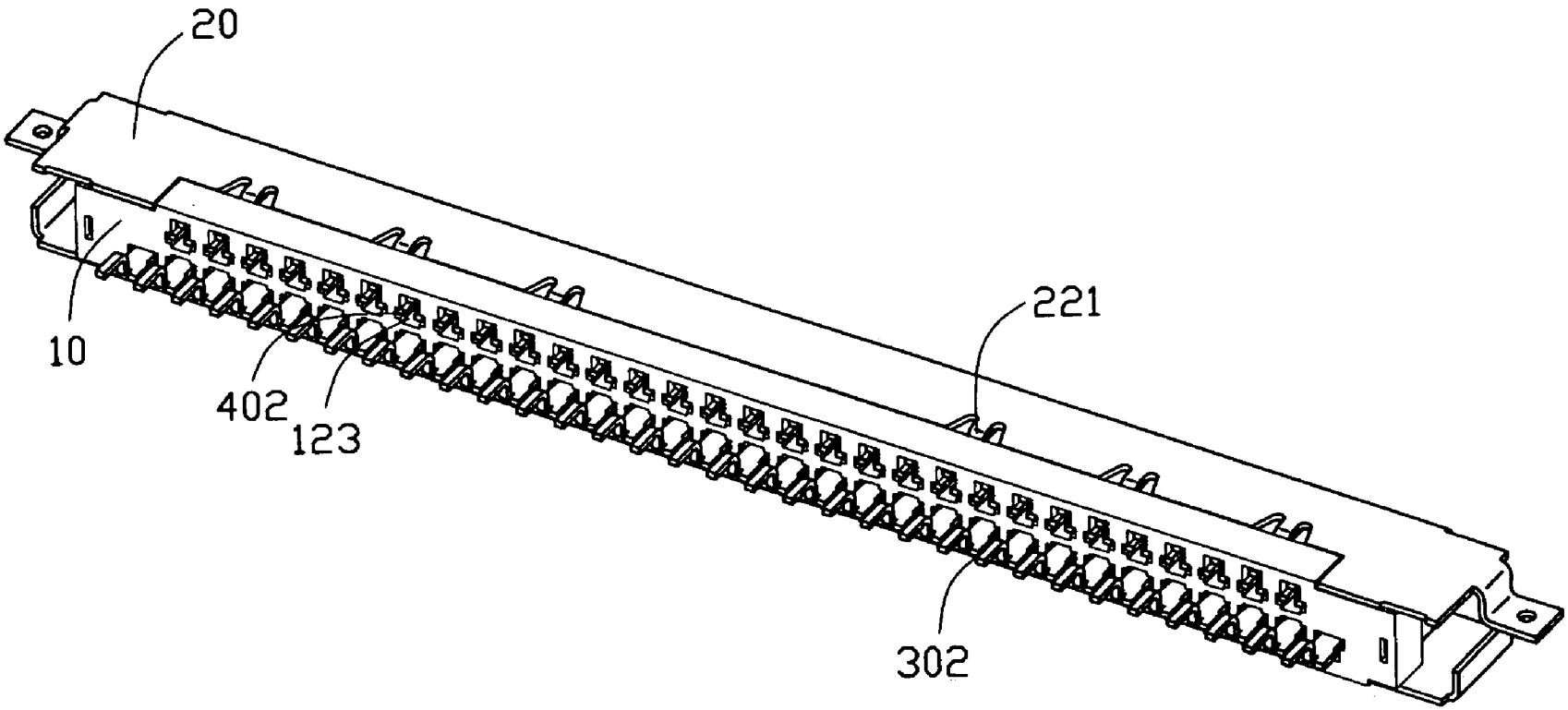
FIG. 4 is an assembled perspective view of the electrical connector of FIG. 3.

Return to FIGS. 1 and 3, the shell 20 is a rectangular annularity comprising an upper shielding wall 21, a lower shielding wall 22, and a pair of side shielding walls 23 respectively for shielding the upper wall 11, the lower wall 12, and the sidewalls 13 of the housing 10. For being reliably attached to the housing 10, the shell 20 is formed with tabs 211 and 221 integrally extending rearwards from its upper shielding wall 21 and lower shielding wall 22 respectively. Correspondingly, for guiding and retaining the tabs 211 and 221, the housing 10 defines grooves 111 and 121 respectively on outer surfaces of its upper wall 11 and lower wall 12. The grooves 111 and 121 run along the front-to-back direction and extend through the rear base 14 as well as the described channels 113 and 123 wherein the grooves 121 on the lower wall 12 come into communication with the lower channels 123 in the rear base 14. During assembly process, the tabs 211 and 221 guidingly slide along the grooves 111 and 121 respectively, and finally enter into the rear base 14 to be retained therein, wherein the tabs 221 come into contact with the bend portion 402 of the elastic terminals 40 in the rear base 14, as best shown in FIG. 6. In addition, the rear wall 14 of the housing 10 has a pair of elongated ends 15 laterally extending beyond the side walls 13. Each elongated end 15 defines a through slot 150 therein for receiving a diminished end of the side shielding wall 23. Thus, the shell 20 is fitly and reliably attached to a periphery of the housing 10 via the engagement between the tabs 211, 221 and the rear base 14 and the engagement between the side shielding wall 23 and the elongated ends 15. The assembled views of the connector 1 are shown in FIGS. 2 and 4. The shell 20 further comprises a pair of ears 220 laterally extending from the lower shielding wall 22 for locking the assembled connector 1 to the PCB, which can also be grounded to the PCB as well in some instance.

As best shown in FIGS. 1 and 5, additionally the shell 20 has a pair of elastic tab 212 extending rearwards and downwards from the upper shielding wall 21 thereof for correspondingly contacting the grounding terminals 32 respectively. A pair of cutouts 112, which communicate with the mating slot 100, are defined in the upper wall 11 at the positions corresponding to the grounding terminals 32 for allowing the elastic tabs 212 to extend into the side upper channels 114 to contact the retaining portions of the grounding terminals 32. Referring to FIG. 5 conjunction with FIG. 6, as the shell 20 contacts both the elastic terminals 40 and the grounding terminals 32, a grounding path from the elastic terminals 40 to the shell 20 then to the grounding terminals 32 and finally to the PCB is created.

As the signal terminals 31 and the grounding terminals 32 are formed from one and the same metal sheet and are assembled to the housing 10 in a row as a whole, the solder tails 302 thereof can perform a wonderful coplanarity and therefore all of them can be reliably soldered to the PCB.

However, the disclosure is illustrative only, changes may be made in detail, especially in matter of shape, size, and arrangement of parts within the principles of the invention. For example, the elastic terminals 40 would be replaced by a metal plate with elastic tongues thereon similar to that is mentioned above in the section of Description of Related Art. Such a replacement will produce little influence on the benefit of the invention.

What is claimed is:

1. An electrical connector comprising:

a longitudinal housing defining a mating slot;

a plurality of signal terminals loaded in the housing and arranged in a row along a longitudinal direction of the housing, each signal terminal having a solder tail to be soldered to a printed circuit board (PCB) and a contact portion extending into the mating slot;

at least a grounding terminal arranged in the same row as the signal terminals and having a solder tail coplanar with the solder tails of the signal terminals;

a conductor means loaded in the housing and partly extending into the mating slot to oppositely facing the contact portions of the signal terminals; and a shell surrounding the housing and electrically connected to the conductor means and the grounding terminals; wherein the signal terminals and the grounding terminal are about the same in configuration, except the grounding terminals have no contact portion extending into the mating slot for contacting a complementary connector.

2. The electrical connector as claimed in claim 1, wherein the signal terminals and grounding terminals are formed from a same metal sheet.

3. The electrical connector as claimed in claim 2, wherein the signal terminals and grounding terminals are linked by a tailing of the metal sheet as an integral one while being assembled to the housing.

4. The electrical connector as claimed in claim 1, wherein the conductor means is a row of elastic terminals each having a retaining portion retained in the housing and a contact beam extending into the mating slot.

5. The electrical connector as claimed in claim 4, wherein the elastic terminal is formed without solder tail to be soldered to the PCB.

6. The electrical connector as claimed in claim 1, wherein the shell is fanned with an elastic tab for contacting the grounding terminal to establish electrical connection.

7. The electrical connector as claimed in claim 6, wherein the housing defines a cutout for allowing the elastic tab to extend into the mating slot to contact the grounding terminal.

8. The electrical connector as claimed in claim 7, wherein the grounding terminal has a retaining portion, and the housing defines a channel communicating with the mating slot end, the cutout for receiving the retaining portion, and wherein the elastic tab contacts the grounding terminal at the retaining portion.

9. An electrical connector comprising:

a longitudinal housing;

a row of terminals arranged in the housing along the longitudinal direction of the housing wherein the terminal located in a longitudinal end of the row serves as a grounding terminal and the other terminals serve as signal terminals, both the grounding terminal and the signal terminals being about the same in configuration and each having a solder tail adapted to be soldered to a PCB, the signal terminals each having a contact portion for contacting a complementary connector but the grounding terminal having no such a contact portion for contacting the complementary connector; and a shell surrounding the housing and electrically connected to the grounding terminal.

10. The electrical connector as claimed in claim 9, further comprising a conductor means arranged to oppose the row of the grounding terminal and the signal terminals, the conductor means electrically connected to the shell.

11. The electrical connector as claimed in claim 10, wherein the conductor means is a row of elastic terminals substantially extending parallel to the grounding terminal and the signal terminals.

12. An electrical connector for mating with a complementary connector, comprising:

a longitudinal housing defining a mating slot;

a plurality of signal terminals loaded in the housing and arranged in a row along a longitudinal direction of the housing, each signal terminal having a solder tail to be soldered to a printed circuit board (PCB) and a contact portion extending into the mating slot;

at least a grounding device disposed in the housing; and a metallic shell surrounding the housing and mechanically and electrically engaged with the grounding device; wherein the grounding device includes a first grounding member located on a same row with the signal terminals and including a solder tail to be solder on the printed circuit board while having no portion engaging with the complementary connector; and a second grounding member located on a different row with regard to the signal terminals and including no solder tail to be soldered on the printed circuit board while having a contact section engaging with the complementary connector.

13. The electrical connector as claimed in claim 9, wherein the row of terminals are formed from a same metal sheet and integrally assembled to the housing for a good coplanarity.

14. The electrical connector as claimed in claim 12, wherein said metallic shell includes at least one contact finger extending rearwardly and inwardly to engage the grounding device.

15. The electrical connector as claimed in claim 14, wherein said contact finger engages either the first grounding member or the second grounding member.

16. An electrical connector for engagement with a complementary connector, comprising:

a longitudinal housing having a main body defining a mating slot therein;

a plurality of signal terminals loaded in the housing and ranged in a row along a longitudinal direction of the housing, each signal terminal having a solder tail to be soldered to a printed circuit board (PCB) and a contact portion extending into the mating slot;

at least a grounding device disposed in the housing; and a metallic shell surrounding the housing and including at least one contact finger extending inwardly to mechanically and electrically directly engaged with the grounding device at a position hidden behind the housing and not directly exposed to an exterior; wherein the grounding device is located in the same row with the signal terminals, and by no means, engages the complementary connector but including a solder tail section to be soldered on the printed circuit board.

17. The electrical connector as claimed in claim 16, wherein the solder tail section of the grounding device is unitarily formed with the grounding device.

* * * * *